US005984652A

United States Patent [19]

Gruett et al.

[11] Patent Number: 5,984,652

[45] Date of Patent: Nov. 16, 1999

[54] SINGLE-PIECE PISTON WITH CENTRAL BORE FOR USE IN A PNEUMATICALLY-ACTIVATED PUMP

[75] Inventors: Donald G. Gruett, Manitowoc; Scott Wright, Pewaukee, both of Wis.

[73] Assignee: Oil-Rite Corporation, Manitowoc, Wis.

[21] Appl. No.: 08/877,291

[22] Filed: Jun. 17, 1997

[51] Int. Cl.[6] ..... F04B 369/10

[52] U.S. Cl. ..... 417/553; 417/555.1; 417/570

[58] Field of Search ..... 417/401, 553, 417/555.1, 570; 184/7.4, 39.1, 55.2; 92/182, 183

[56] References Cited

U.S. PATENT DOCUMENTS

| | | | |
|---|---|---|---|
| 454,613 | 6/1891 | Downie et al. . | |
| 1,442,488 | 1/1923 | Schlumbrecht . | |
| 3,485,180 | 12/1969 | Wickenberg et al. | 103/158 |
| 3,544,239 | 12/1970 | Graham | 417/403 |
| 3,731,763 | 5/1973 | Thrasher, Jr. et al. | 184/7 |
| 4,096,924 | 6/1978 | Lyden | 184/58 |
| 4,125,176 | 11/1978 | Thrasher, Jr. | 184/56 |
| 4,450,938 | 5/1984 | Davenport et al. | 184/42 |
| 4,784,578 | 11/1988 | Gruett | 417/225 |
| 4,784,584 | 11/1988 | Gruett | 417/399 |
| 4,975,028 | 12/1990 | Schultz | 417/442 |
| 5,002,156 | 3/1991 | Gaunt | 184/39.1 |
| 5,253,984 | 10/1993 | Gruett et al. | 417/401 |
| 5,299,917 | 4/1994 | Schultz | 417/238 |
| 5,338,166 | 8/1994 | Schultz | 417/442 |
| 5,443,370 | 8/1995 | Wang | 417/238 |
| 5,449,278 | 9/1995 | Lin | 417/526 |
| 5,638,920 | 6/1997 | Gruett | 184/7.4 |

*Primary Examiner*—Timothy S. Thorpe
*Assistant Examiner*—Cheryl J. Tyler
*Attorney, Agent, or Firm*—Godfrey & Kahn, S.C.

[57] ABSTRACT

A single-piece piston for use in a pneumatically-activated pump to meter a predetermined amount of lubricant or other liquid. The piston has a grooved end that includes a head portion and a circumferentially-disposed angled channel for containing a sealing member such as an O-ring. An adjacent stem section includes a longitudinally-disposed channel that is in fluid-flow connection with the angled channel. The piston is disposed within a chamber of the body of the pump. Lateral movement of the piston within the body causes the sealing member to shift and block and unblock the end of the longitudinal channel and an aperture in the angled channel, which allows liquid from a liquid chamber to flow into a central bore in the piston and to a pump chamber adjacent to the head of the piston's grooved end. The piston operates in association with an assembly for regulating the amount of liquid metered by the lubricator, a valve assembly for evacuating the liquid from the pump chamber into and through an outlet fitting, and a mechanism for regulating the flow of air into the outlet fitting to atomize the liquid.

16 Claims, 6 Drawing Sheets

FIG. 5

SINGLE-PIECE PISTON WITH CENTRAL BORE FOR USE IN A PNEUMATICALLY-ACTIVATED PUMP

FIELD OF THE INVENTION

The present invention relates to devices that are used to precisely meter a liquid. More particularly, the invention relates to a piston or injector used in a pneumatically-activated lubricator or other pump that can meter a precise volume of fluid such as a lubricant.

BACKGROUND OF THE INVENTION

Pneumatically-activated pumps are known and used for metering a desired amount of a lubricant or other fluid from a source to a tool or machine. One type of pneumatically-activated pump is an air tool lubricator that is used to deliver precise amounts of a lubricant, typically an oil, to an air tool. The air tool lubricator is coupled to an air line upstream from the air tool and senses air flow when the tool is cycled, whereupon the lubricator injects a precise volume of lubricant into the airline. The air stream in the air line then carries the lubricant to the air tool. An example of an air tool lubricator is found in U.S. Pat. No. 4,450,938 (Davenport) which has a single ball check design that deposits oil directly into the air line.

In other lubricators, such as the Servo Meters™ lubricator (Master Pneumatic-Detroit, Inc.), air pressure on a piston pushes a metering pin into a bored hole a preset distance which forces the lubricant through a check valve and into a lubricant line. A ball check valve is used at the air tool so that the lubricant line remains filled with lubricant. A drawback of these lubricators is a tendency to entrap air within the device which reduces their precision.

Other pumps, such as the lubricator shown in U.S. Pat. No. 4,784,584 (Gruett), are made with a two-piece piston arrangement composed of a metering piston and an actuating piston that moves in response to air pulses. The dual-piston construction prevents air from being entrapped within the device, providing more accurate metering of liquid to the air tool. However, the two-piece design is relatively complex, and increases the time and precision required to manufacture a lubricator.

Accordingly, it would be desirable to have a pneumatically-activated pump with a relatively simple design, and which is capable of preventing air from being entrapped inside it. It would also be desirable to have a piston for use in a pneumatically-activated lubricator or other pump that is constructed from relatively few components, and is capable of reducing or preventing air entrapment in the pump.

SUMMARY OF THE INVENTION

Therefore, it is an object of the present invention to provide a pneumatically-activated lubricator that has a relatively simple design for metering an amount of lubricant or other liquid to an air tool. Another object is to provide a single-piece piston for use in a pneumatically-activated lubricator that is designed to reduce or prevent air entrapment in the lubricator. Yet another object is to provide a single-piece piston having a channel and bore that allows lubricant to flow through the piston in a controlled manner.

These and other objects and advantages are achieved in a pneumatically-activated lubricator (which is more broadly described as a pump) having a piston disposed within a chamber. The piston is a single-piece construction and operates in conjunction with air and liquid adjustment assemblies and an evacuation valve assembly to meter a precise amount of lubricant.

The single-piece piston has a first grooved end section with a flat head and first and second channels that are circumferentially disposed about the piston. The first channel is angled and has a movably seated, second sealing member, such as an O-ring therein. The angled channel is roughly U-shaped, with one side being deeper than the other and has an aperture positioned in its base. A sealing member, such as an O-ring, sits in the second channel. The aperture leads to a transverse oriented passageway. A longitudinal bore extends from the flat head through the center of the first grooved end to at least the transverse passageway.

The piston also has a stem section that is adjacent to the grooved end. The stem section has a slot that extends longitudinally along the exterior of the stem and forms a conduit for the flow of liquid into the second, angled channel. When the piston is disposed within the body of a lubricator, lateral motion of the slidable piston causes the sealing member in the angled channel to move between a first position adjacent one side of the channel and a second position adjacent the other side of the channel. With the sealing member in the first position, the end of the conduit and an aperture in the bottom of the angled channel are uncovered, and liquid from a liquid chamber surrounding the stem of the piston is allowed to flow into the conduit, into the angled channel, and through the central bore to a metering or pump chamber adjacent to the head of the piston. When in a position in the angled channel, the sealing member blocks the end of the conduit and the aperture in the angled channel to prevent liquid from flowing from the conduit into the channel and the central bore.

The piston operates in conjunction with an assembly (liquid adjustment stem) that regulates its stroke, a valve assembly for assisting the evacuation of liquid from the pump chamber into a central bore in an outlet fitting, and a mechanism that regulates the flow of an air source into the bore of the outlet member to atomize the liquid flowing therethrough. The piston and most other components are disposed in chambers within the body and the body includes openings for receiving tubing for conducting compressed air and liquid into the appropriate chambers in the apparatus.

One end of the liquid adjustment stem is positioned against the piston and the other end extends out an opening in the body so that the user can adjust and regulate the amount of liquid metered by the lubricator. The evacuation valve assembly is disposed within a liquid evacuation chamber. One end of the evacuation valve assembly is coupled to the outlet fitting. The other end of the evacuation valve assembly includes a valve that is removably seated against the outlet of the pump chamber.

An output air flow adjustor is disposed through another opening in the body with one end controlling the flow of air into the outlet fitting. The air introduced into the outlet fitting atomizes the liquid therein. The other end of the air adjustor stem assembly extends out of the body so that the user can regulate the flow of air into the central bore of the outlet fitting. The end of the outlet fitting that projects from the body is adapted to be coupled to a tube to carry the liquid to an air tool or other device or object.

The lubricant is discharged in a predetermined amount by the action of the piston. The stroke of the piston determines the amount of liquid metered and the stroke is controlled by the liquid adjustment stem. Advantageously, the present invention provides a lubricator that incorporates a single piston to meter the liquid that effectively prevents entrapment of air within the lubricator and achieves this goal with a relatively simple design that eliminates the need for a dual-piston set-up as used in other lubricators. The present piston also allows precision metering of very small volumes of liquid (e.g., less than 4/10,000 th ml per cycle) at a wide range of cycle rates (e.g., 20 cycles per second to one cycle per day) and can be readily calibrated for preset output volumes. Another advantage of the piston is that it may be used with a variety of petroleum and synthetic lubricants and even water and other liquids depending on the application at hand.

BRIEF DESCRIPTION OF THE DRAWINGS

Throughout the following views, reference numerals will be used on the drawings, and the same reference numerals will be used throughout the several views and in the description to indicate same or like parts of the invention.

DETAILED DESCRIPTION

Figure 1:
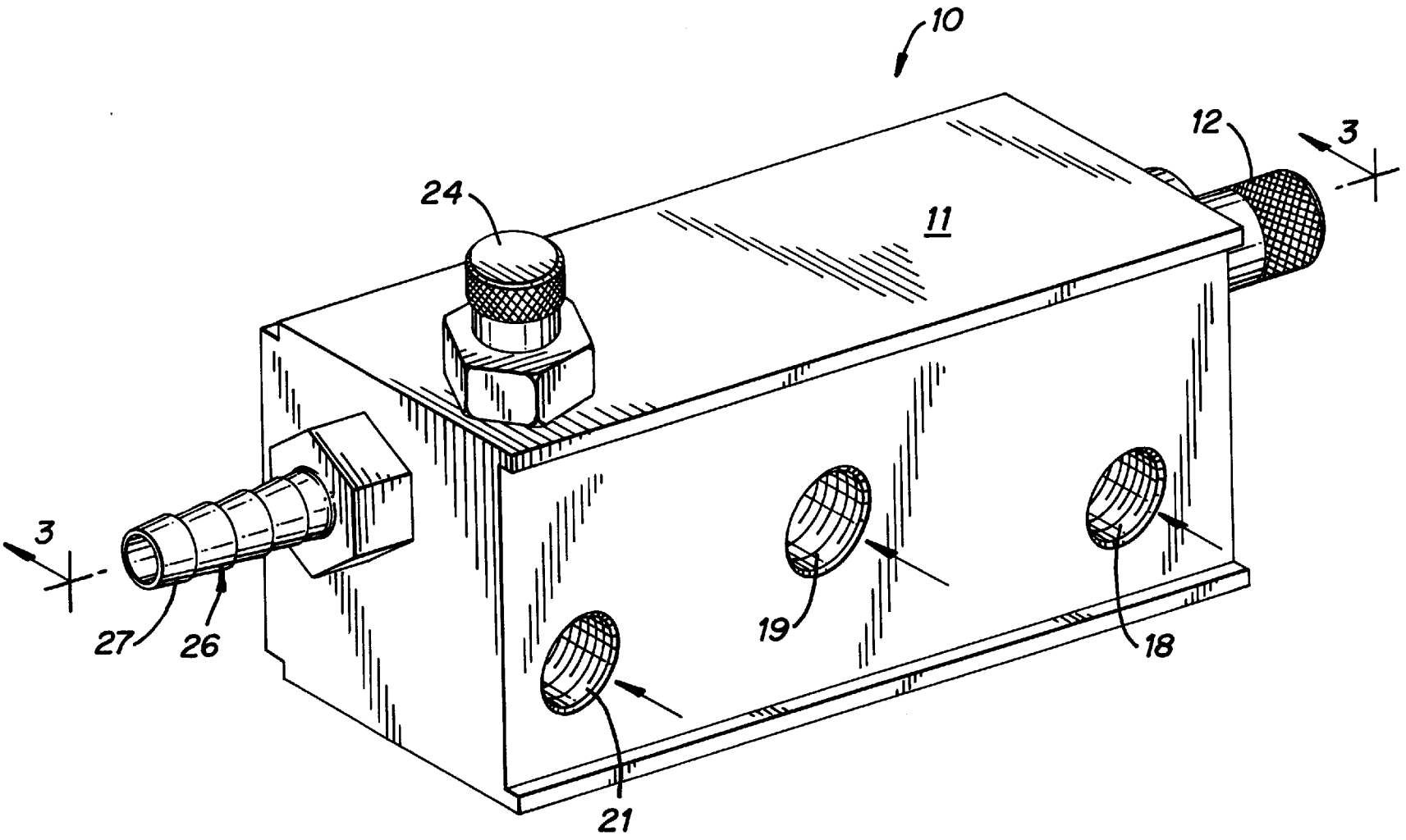
FIG. 1 is a perspective view of a pneumatically-activated lubricator constructed according to the present invention.

Referring now to the drawings, an embodiment of a pneumatically-activated lubricator 10, incorporating the single-piece piston 38 of the invention is shown in FIG. 1. It is understood that the piston 38 can be incorporated into a variety of lubricators and, more generally, pumps that are pneumatically-activated to deliver a liquid to a desired location in a controlled manner. However, for purposes of explanation, the operation of the piston in one specific lubricator is described herein.

Figures 2, 2A:
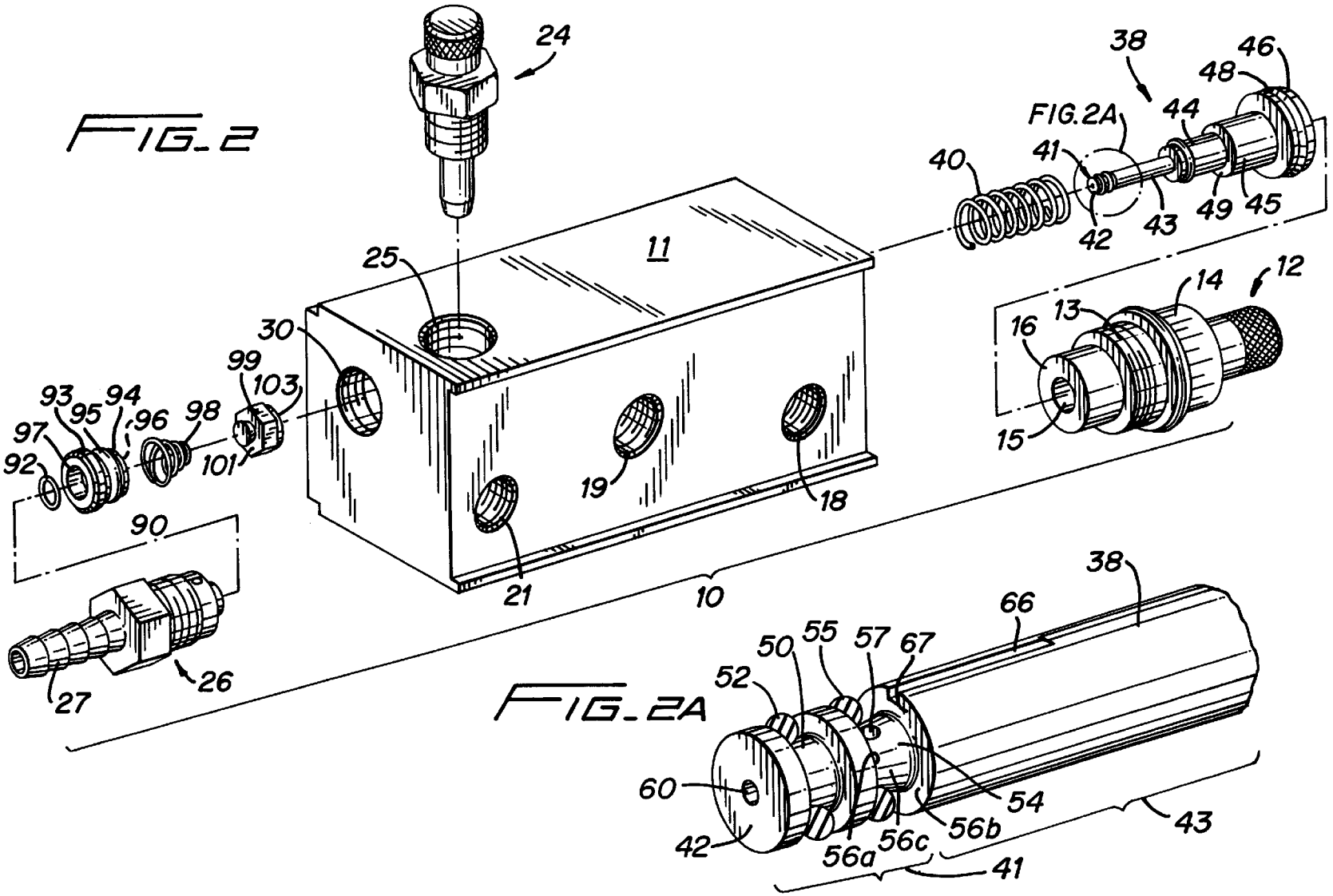
FIG. 2 is a perspective, exploded view of the lubricator of FIG. 1.
FIG. 2A is an enlarged perspective view of a portion of the piston of FIG. 2.

As depicted in FIG. 1, the lubricator 10 includes a main body 11 and a liquid adjustment stem 12. As can be seen in FIG. 2, the liquid adjustment stem 12 has a threaded portion 13, a graduated portion 14, a central bore 15, and a stop end 16. The body 11 also includes a first air inlet bore 18 and a liquid inlet bore 19. The lubricator 10 includes a second air inlet bore 21, and an assembly 24 for adjusting the output air flow ("output air flow adjustor") for atomizing the liquid. The assembly 24 is removably inserted into a bore 25. A barbed, outlet fitting 26 having an outlet end 27 is mounted on one end of the body 11.

Figure 3:
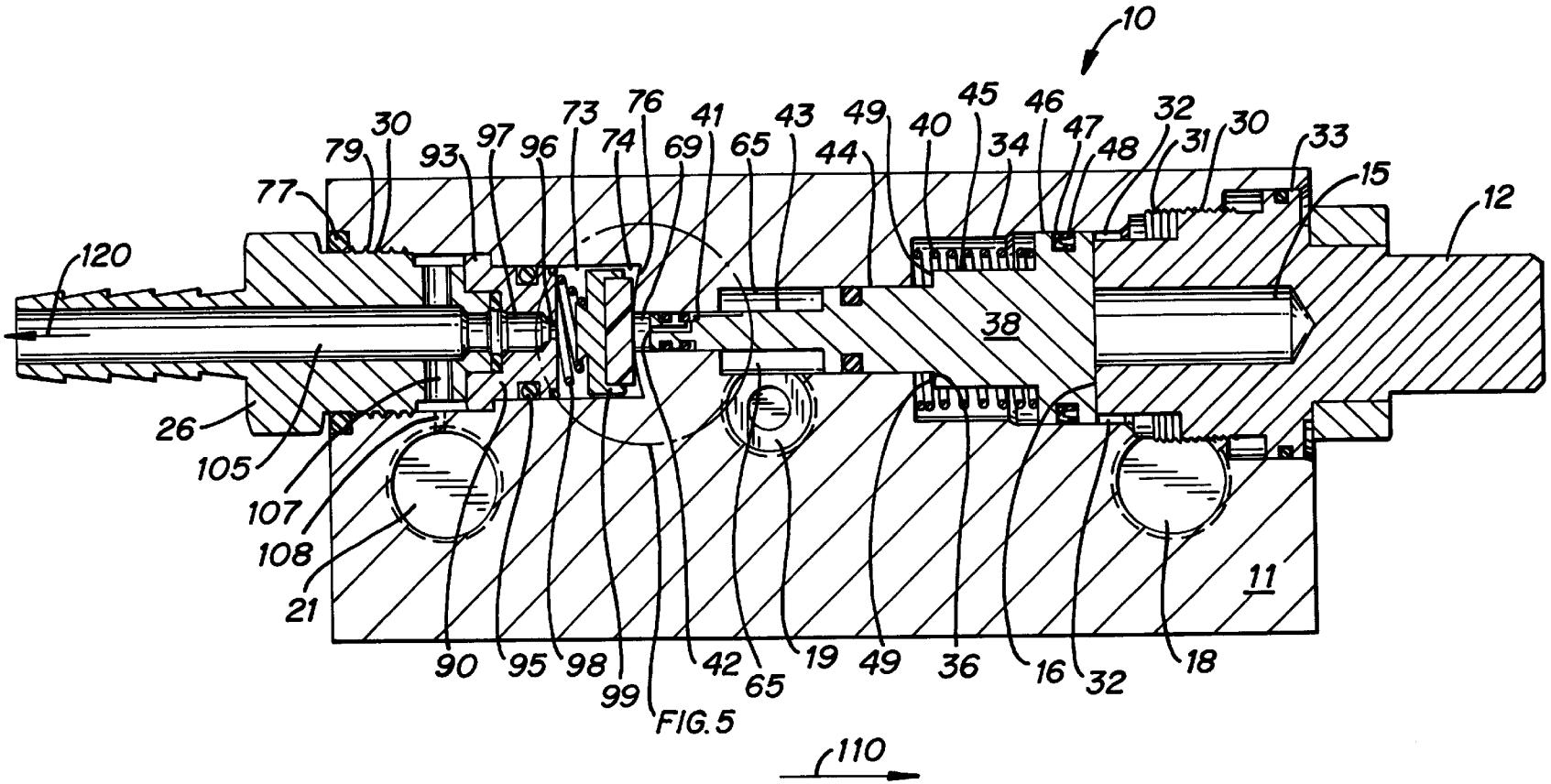
FIG. 3 is a cross-sectional view of the lubricator of FIG. 1 taken along line 3—3 and showing the piston in a first position in the lubricator.
Figure 4:
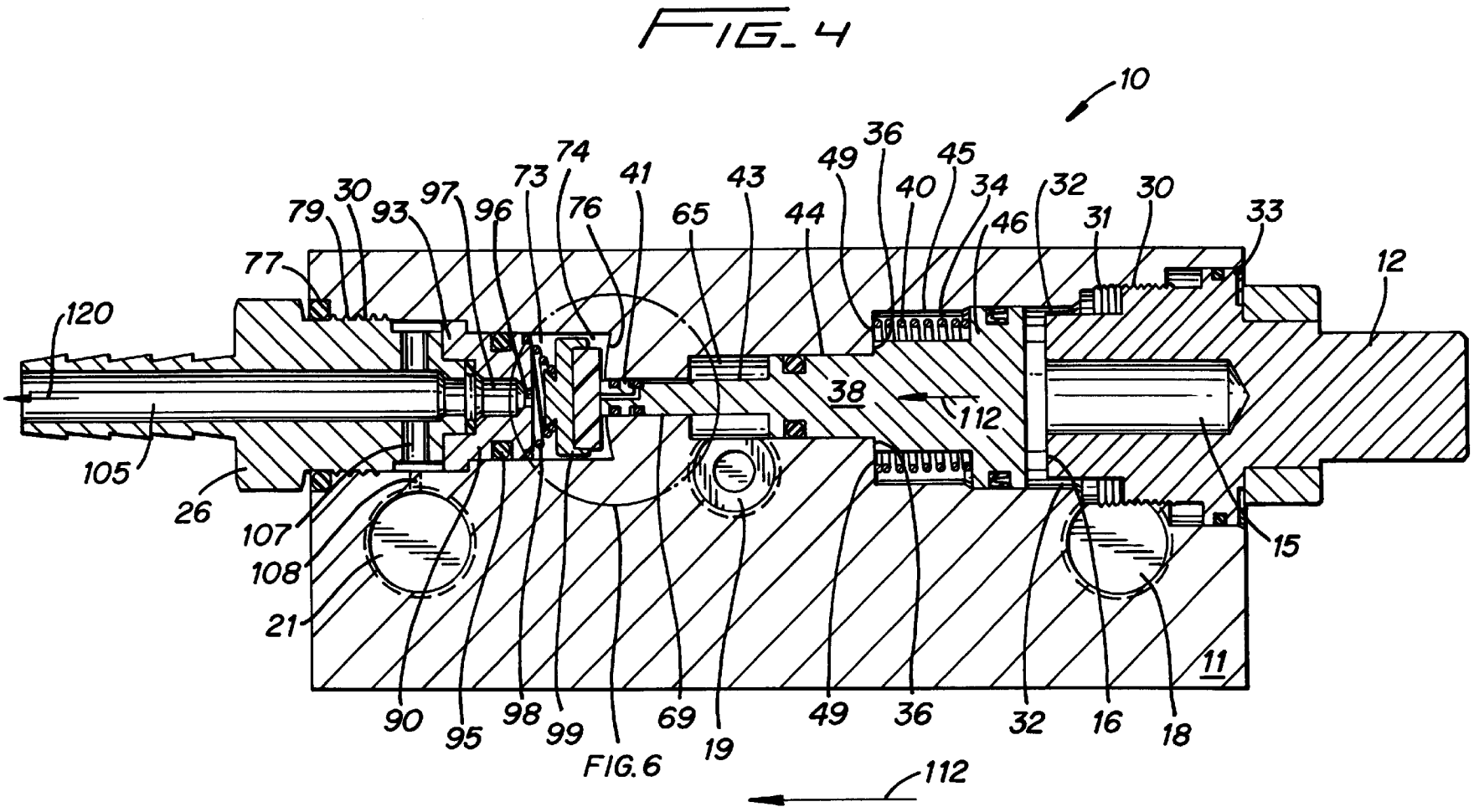
FIG. 4 is a cross-sectional view as in FIG. 3, showing the single-piece piston in a second position in the lubricator.

As best seen by reference to FIGS. 2, 3, and 4, a central bore 30 extends the entire length of the body 11 and defines a plurality of chambers. As shown in FIGS. 3 and 4, the body 11 includes an air inlet chamber 31. The inlet chamber 31 has an opening 33 and a threaded sidewall that is adapted to receive the liquid adjustment stem 12. The stop end 16 of the liquid adjustment stem 12 and the inlet chamber 31 are sized such that there is a gap 32 between the stop end 16 and the inlet chamber 31. In addition, the inlet chamber 31 is in fluid communication with the first air inlet bore 18. Adjacent to the inlet chamber 31 is a piston chamber 34 that is adapted to receive the piston 38.

The piston 38 has a first grooved end section 41 with a head portion 42, a stem section 43, a first intermediate section 44, a second intermediate section 45, and a second disc-shaped end section 46. The second disc-shaped end section 46 has a groove 47 and a sealing member 48 seated therein. Preferably, the piston 38 is made from a single piece of hard and durable material such as steel, stainless steel, plated steel, brass, and the like.

The piston 38 is biased in a first position within the piston chamber 34 by a spring 40. The piston 38 has a stepped design such that the diameter of the disc-shaped end 46 is greater than the diameter of the second intermediate section 45 which is, in turn, greater than the diameter of the first intermediate portion 44. The piston 38 is stepped to provide an annular shoulder 49 that engages the vertical wall or stop 36 of the piston chamber 34 to terminate the working stroke or forward movement of the piston 38.

The first grooved end 41 has a first, angled channel 54 in which a sealing member 55, such as an O-ring, sits. The first grooved end section 41 of the piston 38 optionally includes a second channel 50 (FIG. 2A) in which a second sealing member 52, such as an O-ring, sits. As best seen by reference to FIGS. 5 and 6, the angled channel 54 is roughly U-shaped, with a first side 56*a*, a second side 56*b*, and a bottom or base portion 56*c* therebetween that is slanted or oriented at an angle from the first side 56*a* to the second side 56*b* such that the channel 54 is deepest adjacent the first side 56*a*. An aperture 57 is positioned in the base portion 56*c* of the angled channel 54 and is coupled in fluid flowing relation to a passageway 59. A centrally-disposed bore 60 extends from the head section 42 through the center of the first grooved end 41 to at least the passageway 59.

A part of the first intermediate section 45 and the stem section 43 of the piston 38 are positioned in a liquid chamber 65 (FIG. 3). The stem section of the piston 38 includes a longitudinal slot or conduit 66 having an end 67 for transferring liquid from the liquid chamber 65 into the angled channel 54. The liquid chamber 65 is in fluid communication through a passageway (not shown) with the liquid inlet bore 19.

Figure 5:
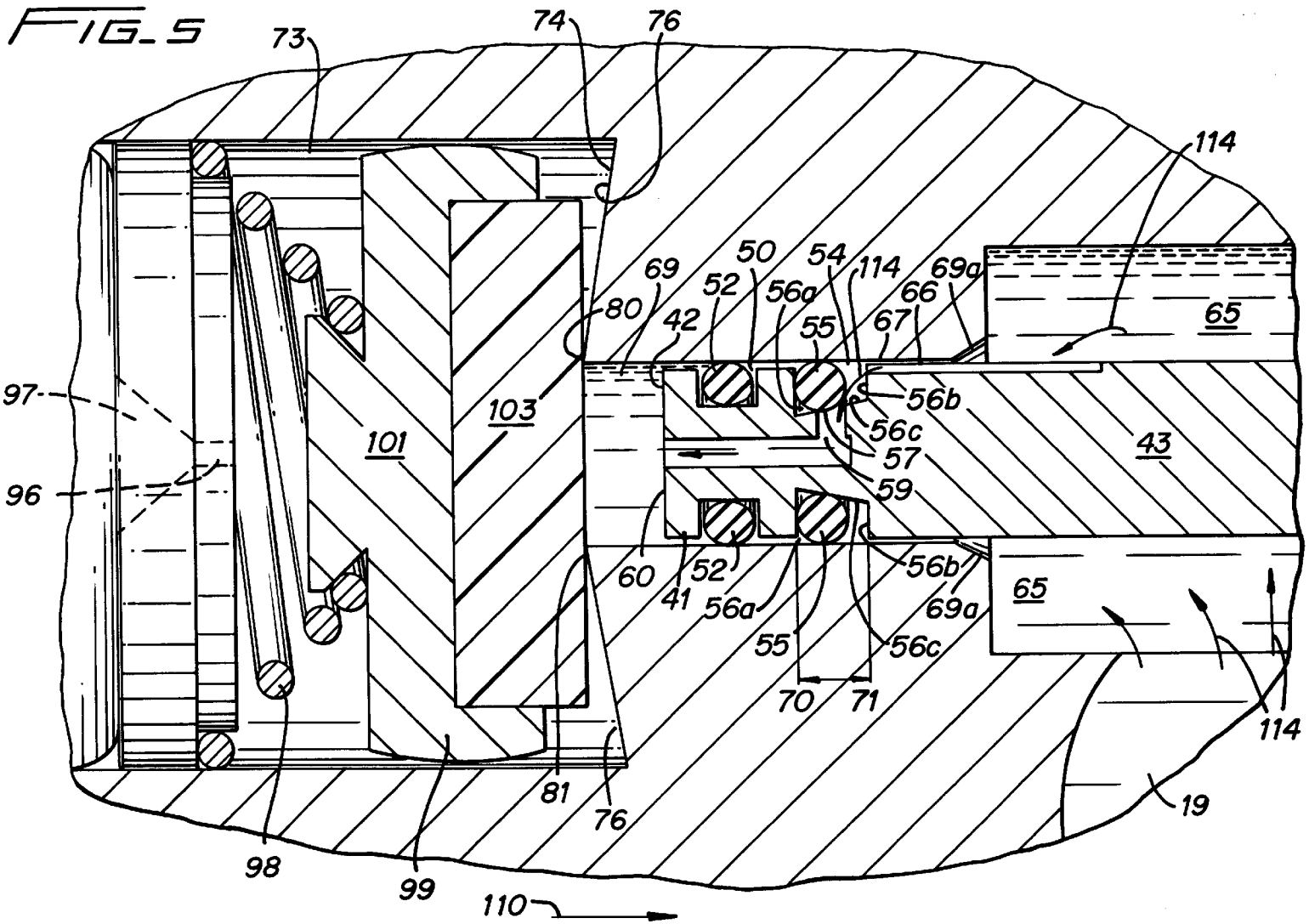
FIG. 5 is an enlarged cross-sectional view of a portion of the piston of FIG. 3.
Figure 6:
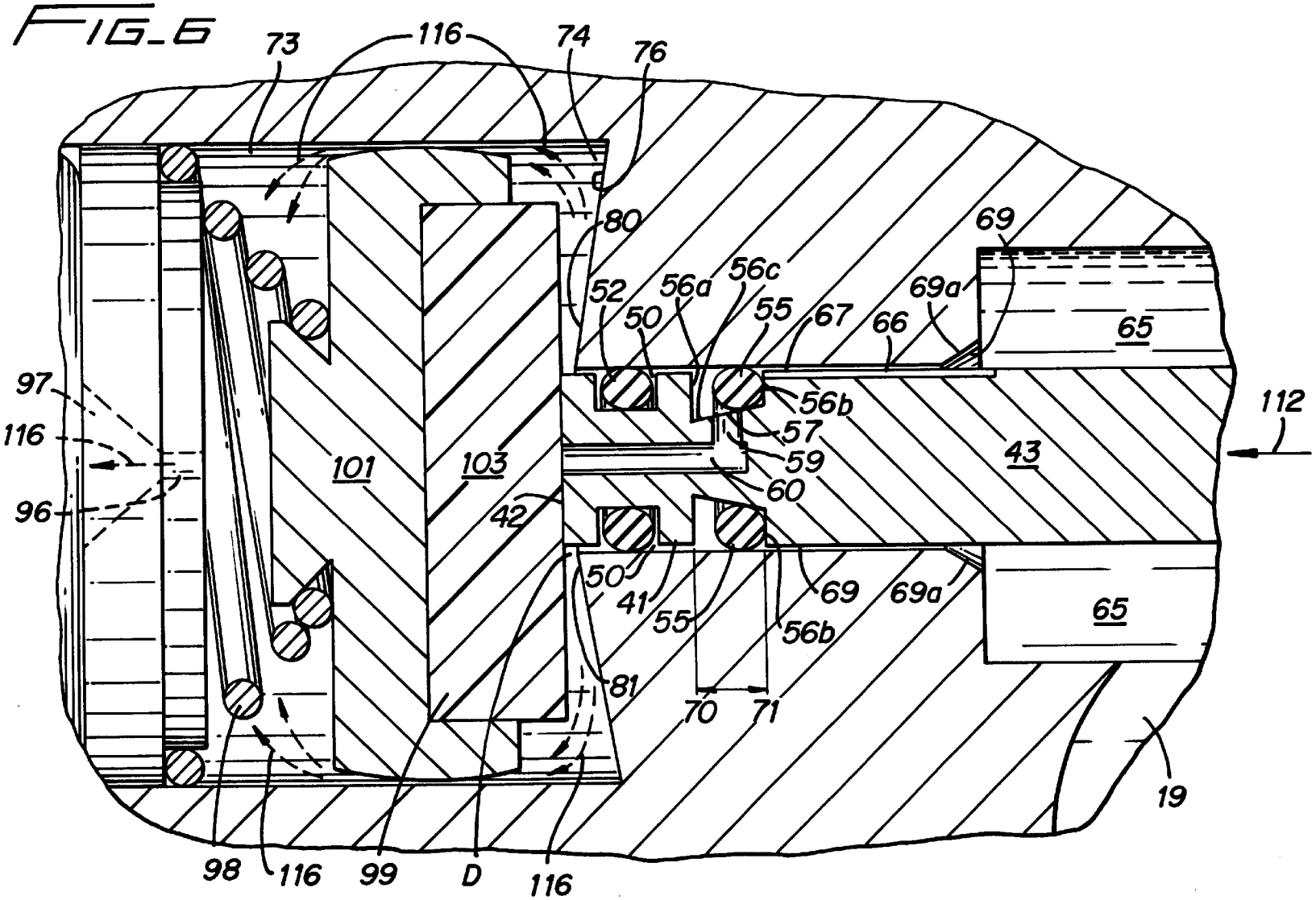
FIG. 6 is an enlarged cross-sectional view of a portion of the piston of FIG. 4.

As best seen by reference to FIGS. 5 and 6, the first grooved end 41 of the piston 38 is positioned within a pump chamber 69 that may have a flaring 69*a*. The sealing member 55 and the angled channel 54 of the piston 38 are sized to allow the sealing member 55 to move between a first position 70 and a second position 71 in the angled channel 54 when the piston 38 moves laterally within the pump chamber 69. To allow the sealing member 55 to freely shift back and forth in the angled channel 54 and seal properly, it is preferred that the base portion 56*c* has an angle of about 10–20° to the center line of the lubricator 10, and preferably about 15°. As shown in FIG. 5, the sealing member 55 is in the first position 70 in the channel 54 (adjacent to first side 56*a*) during the "return stroke" and when the piston 38 is at the top of a cycle, wherein the aperture 57 in the base portion 56*c* and the end 67 of the conduit 66 are uncovered. This allows fluid to flow from the conduit 66 into the angled channel 54 and through the central bore 60 to the metering or pump chamber 69 adjacent to the head 42. The flaring 69*a* helps direct liquid toward the pump chamber 69. As seen in FIG. 6, the sealing member 55 is in the second position 71 in the channel 54 (adjacent to second side 56*b*) on the "down stroke" and when the piston 38 is at the end or bottom of a cycle, wherein the aperture 57 and the conduit 66 are blocked such that fluid does not flow into the angled channel 54 nor the central bore 60.

Adjacent to the pump chamber 69 is a liquid evacuation chamber 73. The evacuation chamber 73 has a first end 74 with a curved and preferably linearly angled wall 76 and a second end 77 (FIGS. 3 and 4) with a threaded portion 79 for receiving the outlet fitting 26. The curved wall 76 has two contact points 80 and 81. Positioned between the outlet fitting 26 and the curved wall 76 is an evacuation valve assembly 90. The evacuation valve assembly includes an O-ring 92, a valve collar or sleeve 93 having a groove 94 in which an O-ring or like sealing member 95 is seated, an aperture 96 that faces the pump chamber 69, and a longitudinal bore 97. The evacuation assembly also includes a biasing means, such as a spring 98, and a poppet valve 99. The poppet valve 99 has a valve nut, such as hexagonally-shaped nut 101, and a plug seal 103. The plug seal 103 is biased against the relatively sharp and defined contact points 80 and 81 to provide a tight seal between the pump and evacuation chambers 69 and 73, respectively.

As noted, the output air flow adjustor 24 is inserted into the bore 25 in the main body 11. A bore 105 in the outlet fitting 26 is coupled in fluid communication to the longitudinal bore 97. An air passageway 107 that is coupled in fluid communication via a passageway 108 to the second air inlet bore 21 allows air to flow into the bore 105. The output air flow adjuster 24 controls the amount of air that flows through the passageway 108 from the second air inlet bore 21, and ultimately the amount of air that flows through the bore 105 to atomize the liquid passing therethrough.

In a preferred embodiment, wherein the sealing member 55 is an O-ring, the angle of the base portion 56*c* of the angled channel 54 is about 15°±5°, the diameter of the angled channel 54 adjacent to the first side 56*a* is about 60–80% of the inside diameter (i.d.) of the O-ring, preferably about 70%, and the diameter of the angled channel 54 adjacent to the second side 56*b* is about 105–125% of the inside diameter of the O-ring, preferably about 115%. It is also preferred that the aperture 57 is centered within the base portion 56*c* of the angled channel 54 so that the O-ring will completely cover and uncover the aperture 57 as it shifts. In addition, to minimize entrapped liquid and prevent vapor lock, it is preferred that the inside diameters of the aperture 57 and the passageway 59 are less than about 10–15% of the inside diameter of the central bore 60, preferably less than about 12%. It is also preferred that the depth of the conduit 66 is less than about 33% of the O-ring cross-section (thickness) in order to prevent liquid loss during the down stroke in the direction of arrow 112 (FIG. 6).

It should be understood that various means beyond the springs and O-rings shown can be used for the purposes of providing the proper biasing and sealing for the components of the present invention.

OPERATION

When properly connected to a source of compressed air, the pneumatically-activated lubricator 10 incorporating the piston 38 of the present invention delivers a precise amount of lubricant or other liquid to the air tool. Preferably and advantageously, the lubricator 10 is designed with a unique evacuation valve assembly 90 and evacuation chamber 73 that prevent air bubbles from being entrapped within the device, which design is based upon an earlier lubricator disclosed in U.S. Pat. No. 4,784,584, the disclosure of which is incorporated by reference herein.

The piston 38 operates in a cycle to feed liquid from the liquid chamber 65 into the metering or pump chamber 69 (FIGS. 3 and 5), and to dispense and pump the liquid past the poppet valve 99, and into the central bores 97, 105 of the sleeve 93 of the evacuation valve assembly 90 and the outlet fitting 26, respectively.

A tube (not shown) couples the liquid inlet bore 19 to a source of liquid, usually a lubricant material. Liquid flows from the tube through the passageway (not shown) into the liquid chamber 65 and into the conduit 66 in the piston 38. Depending on the position of the piston 38, liquid will also flow into the pump chamber 69. The type of liquid or lubricant used depends on the application at hand. However, the present invention is capable of metering various synthetic and petroleum based lubricants and even water. Tubing (also not shown) is connected to the air inlet bore 18 and inlet bore 21 to deliver compressed air from an air source into the inlet chamber 31 and the outlet fitting 26. Air that enters the inlet chamber causes the piston 38 to move. Air that is delivered into the outlet fitting 26 atomizes the liquid received from the evacuation chamber 73.

The lubricator 10 is self-priming and before it is operated for the first time, the liquid chamber 65 and the pump chamber 69 are filled with air. As seen in FIGS. 3 and 5, the poppet valve 99 is biased against the contact points 80 and 81 and seals the pump chamber 69 closed. As the piston 38 is drawn away from the pump chamber 69 (moves to the right) in the direction of arrow 110, the pump chamber becomes pressurized. The sealing member 55 in the piston 38 moves to the first side 56*a* of the angled channel 54 (position 70) such that the end 67 of the conduit 66 and the aperture 57 are uncovered. As shown in FIG. 5 by the arrows 114, liquid from an outside source is drawn in through the liquid inlet tube (not shown), through the liquid inlet bore 19, through the passageway (not shown) into the liquid chamber 65, into the longitudinal conduit 66 in the stem portion 43 of the piston 38, into the angled channel 54 and the passageway 59, through the central bore 60, and out the head 42 to the pump chamber 69.

As seen in FIGS. 4 and 6, when compressed air is injected through the inlet chamber (through an air inlet tube (not shown) coupled to the air inlet bore 18), pressure against the disc-shaped end 46 of the piston 38 increases. When the air pressure in the inlet chamber 31 exceeds the counterforce of the spring 40, the slidable piston 38 is pushed in the direction of arrow 112 toward the poppet valve 99.

The force of the piston 30 against the liquid in the pump chamber 69 causes an increase in the fluid pressure against the poppet valve 99, causing the valve to disengage the contact points 80 and 81 and allowing liquid to flow into the evacuation chamber 73. The piston 38 moves (to the left) in the direction of arrow 112, contacts the poppet valve 99 and pushes the poppet valve 99 a predetermined distance "D" away from the contact points 80 and 81. This distance (D) is about 0.003–0.013 inch and is referred to as the "kick-off" amount. This action ejects all of the measured volume of liquid and any air bubbles that may have been trapped therein, or the pump chamber 69, out of the pump chamber 69 and into the liquid evacuation chamber 73.

As shown by the dashed arrows 116, the liquid flows around the sides of the valve nut 101, around the spring 98, and into the bores 97 and 105 of the sleeve 90 and the outlet fitting 26, respectively. Simultaneously, the sealing member 55 in the piston 38 is caused to move to the second position 71 adjacent to the second side 56*b* of the angled channel 54 wherein the end 67 of the conduit 66 is blocked (but not perfectly sealed) to stop the flow of liquid into the angled channel 54 and the pump chamber 69.

The liquid flowing through the central bore 105 of the outlet fitting 26 can be atomized by air fed in from a second air inlet 21 in the main body 11 of the lubricator 10. The flow of air is varied by adjusting the depth of the insertion of the output air flow adjuster 24 in the bore 25. The atomized liquid travels in the direction of arrow 120 out of the outlet fitting 26 into the connected tubing (not shown) that can be connected to a device such as an air tool (also not shown).

At the end of the cycle, air flow from the compressed air sources stops, the piston 38 slides in the direction of arrow 110 back to its original position, as shown in FIG. 3, and the pump chamber 69 is closed with the plug seal 103 of the poppet valve 99 by the force applied by the spring 98 in the direction of arrow 110 (FIG. 5). When air flows again, the piston cycle is repeated.

Referring to FIGS. 2 and 3, the amount of liquid that is fed into the pump chamber 69 with each working stroke of the piston 38 is adjusted by means of the liquid adjustment stem 12. As noted, the liquid adjustment stem 12 is disposed in the inlet chamber 31. The stem 12 includes a graduated ring to provide a scale for individuals operating the lubricator 10. The gradation permits the operator to gauge or measure the amount he or she has adjusted the stroke of the piston 38. By turning the stem 12 into the body 11, the stroke of the piston 38 is shortened. By turning the stem 12 out of the body 11, the stroke of the piston 38 is increased. Thus, the stem 12 provides a means for adjusting the stroke of the piston 38.

The amount of air flowing to the air inlet bore 18, through the gap 32, and to the piston 38 can be varied by standard controls on the source of compressed air (not shown). Preferably, the source of compressed air will deliver pulses of compressed air at an air pressure of about 30–180 psi that can be adjusted as desired from 0–1200 air pulses per minute.

The invention has been described by reference to detailed examples and methodologies. These examples are not meant to limit the scope of the invention. Variation within the concepts of the invention are apparent to those skilled in the art. The disclosures of the cited references are incorporated by reference herein.

What is claimed is:

1. A piston for use in a pneumatically-activated pump having a chamber, the piston comprising:

a first grooved end section having a head, a first channel circumferentially disposed about the piston, and a bore with an opening at the head and coupled in fluid communication with the first channel; the first channel having a first side, a second side, and a base portion therebetween, being sized to receive a movable sealing member therein, the channel base portion being oriented at an angle from the first side to the second side, with the channel having a depth that is greater adjacent the first side;

a stem section having a longitudinally disposed conduit with a first end and a second end, the first end of the conduit being in a fluid-flowing relation with the first channel; and a second end section;

wherein the sealing member is movable from a first position adjacent to the first side of the channel to a second position adjacent to the second side of the channel, and when the sealing member is seated in and adjacent to the first side of the first channel, the first end of the conduit is open to allow fluid communication between the conduit and the central bore, and when the sealing member is adjacent to the second side of the first channel, the first end of the conduit is blocked by the sealing member to prevent fluid communication between the conduit and the central bore.

2. A piston according to claim 1, further comprising a sealing member movably seated in the first channel.

3. A piston according to claim 1 further comprising a second channel with a sealing member seated therein, the second channel circumferentially disposed in the grooved end between the first channel and the head.

4. A piston according to claim 1, wherein the piston is stepped and has an intermediate section; the second end section having a diameter greater than the diameter of the intermediate section.

5. A pneumatically-activated pump, comprising:

a) a body having a central chamber; and b) a piston disposed in the chamber, the piston comprising:

a grooved end section with a head; a circumferentially disposed channel with a first side, a second side, a base portion therebetween, and a sealing member movably seated therein and the channel base portion being oriented at an angle from the first side to the second side, with the channel having a depth that is greater adjacent the first side; a central bore; and a passageway providing a fluid flowing connection between the central bore and the channel; and a stem section having a longitudinally disposed conduit, the conduit having a first end in fluid-flowing relation with the channel; and a second end;

wherein lateral motion of the piston within the chamber of the pump causes the sealing member to move between a first position where the sealing member is adjacent the first side of the channel with the first end of the conduit open to allow fluid communication between the conduit and the bore, and a second position where the sealing member is adjacent the second side of the channel with the first end of the conduit blocked to prevent fluid communication between the conduit and the central bore.

6. A pump according to claim 5, wherein a chamber for holding a liquid source surrounds the stem.

7. A pump according to claim 5, further comprising an assembly for adjusting the amount of liquid metered by the pump.

8. A piston for use in a pneumatically-activated pump having a chamber; the piston comprising:

a first end and a second end, a channel circumferentially disposed about the piston, and having a first side, a second side, and a base portion therebetween, being sized to receive a movable sealing member therein the channel base portion being oriented at an angle from the first side to the second side with the channel having a depth that is greater adjacent the first side;

means for receiving and conducting a fluid along a length of the piston and out of the first end; and a movable sealing member seated in the channel for alternately opening and closing said fluid receiving/conducting means to prevent fluid flow therethrough;

wherein the sealing member is movable from a first position adjacent to the first side of the channel to a second position adjacent to the second side of the channel, and when the sealing member is adjacent to the first side of the channel, the fluid receiving/conducting means is open to allow fluid flow therethrough, and when the sealing member is adjacent to the second side of the first channel, the fluid receiving/conducting means is closed by the sealing member to prevent fluid flow therethrough.

9. A piston according to claim 8, wherein the fluid receiving/conducting means is a longitudinally-disposed conduit extending part of the length of the piston and in fluid communication with a centrally disposed bore extending from the conduit to the first end of the piston.

10. A piston according to claim 8, wherein the opening/closing means is a movable sealing member seated in a channel circumferentially disposed about the piston between and in fluid communication with the conduit and the central bore; the channel having a first side, a second side, a base portion thereinbetween;

wherein, when the sealing member is seated in and adjacent to the first side of the channel, the first end of the conduit is open to allow fluid communication between the conduit and the channel, and when the sealing member is adjacent to the second side of the channel, the first end of the conduit is closed by the sealing member to prevent fluid communication between the conduit and the channel.

11. A method of metering an amount of liquid using a pneumatically-activated pump;

the pump having a body with a central chamber, and a piston disposed in the chamber; the piston having a first end and a second end, a channel circumferentially disposed about the piston, and having a first side, a second side, and a base portion therebetween, being sized to receive a movable sealing member therein, the channel base portion being oriented at an angle from the first side to the second side, with the channel having a depth that is greater adjacent the first side; means for receiving and conducting a fluid along a length and out of the first end of the piston being composed of a conduit, a channel, and a bore in the piston; and a movable sealing member seated in the channel for alternately opening and closing said fluid receiving/conducting means to prevent fluid flow therethrough; wherein the sealing member is movable from a first position adjacent to the first side of the channel to a second position adjacent to the second side of the channel, and when the sealing member is adjacent to the first side of the channel, the fluid receiving/conducting means is open to allow fluid flow therethrough, and when the sealing member is adjacent to the second side of the first channel, the fluid receiving/conducting means is closed by the sealing member to prevent fluid flow therethrough;

the method comprising the steps of:

delivering a liquid to a liquid chamber in the body of the pump;

moving the piston within the body of the pump to cause the liquid to transfer to a pump chamber in the body of the pump by moving the sealing member adjacent to the first side of the channel wherein the liquid passes through the conduit, the channel, and the bore in the piston; and moving the piston within the body of the pump to cause a metered amount of the liquid to be expelled from the pump chamber.

12. A piston for use in a pneumatically-activated pump having a chamber, the piston comprising:

a first grooved end section having a head, a first channel circumferentially disposed about the piston, and a bore with an opening at the head and coupled in fluid communication with the first channel; the first channel having a first side, a second side, a base portion therebetween, a first diameter adjacent to the first side, and a second diameter adjacent to the second side;

a sealing member having an inner diameter and positioned in the first channel;

a stem section having a longitudinally disposed conduit with a first end and a second end, the first end of the conduit being in fluid-flowing relation with the first channel; and a second end section;

wherein the first diameter of the first channel is about 60–80% of the inner diameter of the sealing member and the second diameter of the first channel is about 105–125% of the inner diameter of the sealing member; and when the sealing member is adjacent to the first side of the first channel, the first end of the conduit is open to allow fluid communication between the conduit and the bore, and when the sealing member is adjacent to the second side of the first channel, fluid communication between the first end of the conduit and the bore is blocked.

13. A piston according to claim 12 further comprising a second channel with a sealing member seated therein, the second channel circumferentially disposed in the grooved end between the first channel and the head.

14. A piston according to claim 12, wherein the piston is stepped and has an intermediate section; the second end section having a diameter greater than the diameter of the intermediate section.

15. A piston according to claim 12, wherein the first diameter is about 70% of the inner diameter of the sealing member, and the second diameter is about 115% of the inner diameter of the sealing member.

16. A piston according to claim 12, wherein the bore has an inner diameter, and the piston further comprises an aperture in the base portion of the first channel and a passageway coupling the aperture and the bore in fluid communication with one another, the aperture and passageway each having an inside diameter that is less than about 10–15% of the inner diameter of the bore.

* * * * *